US011260441B2

(12) United States Patent
Galli et al.

(10) Patent No.: US 11,260,441 B2
(45) Date of Patent: Mar. 1, 2022

(54) PRESS FOR EXTRUDING METAL MATERIAL

(71) Applicant: DANIELI & C. OFFICINE MECCANICHE S.p.A., Buttrio (IT)

(72) Inventors: Alessandro Mario Galli, Costa Masnaga (IT); Michele Ce', Milan (IT); Mattia Merlini, Brescia (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 0 days.

(21) Appl. No.: 16/764,369

(22) PCT Filed: Nov. 23, 2018

(86) PCT No.: PCT/IB2018/059256
§ 371 (c)(1),
(2) Date: May 14, 2020

(87) PCT Pub. No.: WO2019/102410
PCT Pub. Date: May 31, 2019

(65) Prior Publication Data

US 2020/0276626 A1 Sep. 3, 2020

(30) Foreign Application Priority Data

Nov. 24, 2017 (IT) ..... 102017000135085

(51) Int. Cl.
*B21C 23/21* (2006.01)

(52) U.S. Cl.
CPC ..... *B21C 23/211* (2013.01)

(58) Field of Classification Search
CPC ..... B21C 23/21; B21C 23/211; B21C 23/212; B21C 31/00; B30B 15/18; B30B 15/20; B30B 15/22; B30B 15/161; B30B 1/32
See application file for complete search history.

(56) References Cited

U.S. PATENT DOCUMENTS 4,038,907 A * 8/1977 Weiss ..... B30B 11/02 91/20
4,548,296 A 10/1985 Hasegawa
(Continued)

FOREIGN PATENT DOCUMENTS

EP 3056291 A1 * 8/2016 ..... B30B 15/20
JP S51119477 10/1976
(Continued)

OTHER PUBLICATIONS

Patent Cooperation Treaty, International Search Report and Written Opinion for International Application No. PCT/IB2018/059256, dated Apr. 23, 2019, 12 pages.

*Primary Examiner* — Adam J Eiseman
*Assistant Examiner* — Matthew Stephens
(74) *Attorney, Agent, or Firm* — Stetina Brunda Garred and Brucker

(57) ABSTRACT

The invention relates to a press for extruding metal material. The press comprises a hydraulic oil circuit for controlling one or more extrusion pistons movable within corresponding cylinders. Such a circuit comprises a fixed displacement, circulation pump operated by an electric motor with variable rotation speed. The hydraulic circuit comprises a main line and a branch line, along which a shutoff element is arranged. The hydraulic circuit comprises a hydraulic control unit comprising a pilot valve arranged along a pilot line provided with a first segment communicating with the main line and a second discharging segment. Said hydraulic unit is provided to move the shutoff element between an opening position and a closing position of the branch line according to the difference between the oil pressure upstream of the shutoff element and that in the first segment of said pilot line. The hydraulic circuit further comprises a control element which, in an activation condition, and as a result of the activation of said pilot valve, determines a gradual increase
(Continued)

of the pressure in the first segment of said pilot line and a corresponding gradual closing movement of said shutoff element causing a consequent gradual increase of the thrust on the piston until the reference speed is reached.

3 Claims, 5 Drawing Sheets

(56) References Cited

U.S. PATENT DOCUMENTS 4,588,539 A * 5/1986 Rossi ..... B30B 1/261
264/40.5
5,158,723 A * 10/1992 Walchhutter ..... B30B 15/16
100/269.14
2015/0033963 A1* 2/2015 Rauwolf ..... B30B 1/32
100/269.06
2016/0186786 A1* 6/2016 Wahler ..... F15B 20/00
60/327
2017/0312810 A1* 11/2017 Kuwano ..... B30B 1/34
91/20

FOREIGN PATENT DOCUMENTS

JP S57157803 A * 9/1982 ..... F15B 11/05
JP S57195902 12/1982
JP S58168422 10/1983
JP S62238017 10/1987
JP H02168002 6/1990
JP H0538600 2/1993
JP H06249206 9/1994
JP 07232300 12/1995
JP H08206899 8/1996
JP 2004301189 10/2004
WO WO-2017216737 A1 * 12/2017 ..... B30B 15/20

* cited by examiner

PRESS FOR EXTRUDING METAL MATERIAL

CROSS-REFERENCE TO RELATED APPLICATIONS

This application claims priority to PCT International Application No. PCT/IB2018/059256 filed on Nov. 23, 2018, which application claims priority to Italian Patent Application No. 102017000135085 filed on Nov. 24, 2017, the disclosures of which are expressly incorporated herein by reference.

STATEMENT RE: FEDERALLY SPONSORED RESEARCH/DEVELOPMENT

Not applicable.

TECHNICAL FIELD

The present invention relates to a press for extruding metal material, which may be steel, aluminum, copper, lead, a ferrous or non-ferrous alloy. In particular, the press according to the invention is fed by at least one fixed displacement circulation pump driven by an asynchronous electric motor.

BACKGROUND ART

Typically, an extrusion press comprises a plurality of cylinders in each of which a piston moves, acting on the metal material, in plastic state, pushing it through a die which configures the section of the extruded profile with the shape thereof.

The extrusion speed, i.e. the speed of the piston in the cylinder, is established on the basis of various parameters, such as the extruded material type and the die complexity. In this regard, the movement of the piston is controlled by means of a hydraulic circuit which includes the use of a hydraulic pump driven by a motor. The speed of the piston depends directly on the oil flow which is sent by the pump into the cylinder.

In a first known embodiment, the hydraulic circuit is provided with a variable displacement pump which is operated by an electric motor which turns at a constant revolutions per minute. The speed of the piston thus varies according to the oil volume which is sent by the pump according to the configuration assumed by the flow regulating means integrated in the pump itself. The main drawbacks of this embodiment are primarily in the use of constant speed motors, which must be kept in constant actuation, also during the periods in which the press is not working. Another drawback is represented by the cost of variable displacement pumps and the complexity thereof, which requires frequent and accurate maintenance interventions in order to contain possible component failures.

In order to overcome these drawbacks at least partly, it has been suggested and used a hydraulic circuit in which a fixed displacement pump is provided and in which the oil flow sent to the cylinder is adjusted by varying the revolutions per minute of the motor which drives the pump. In particular, the variation of the revolutions per minute is obtained by intervening on the supply frequency of the electric motor. Motors capable of rapidly varying their rotation speed are used to ensure fast response time, i.e. a quick response of the circuit. In particular, electric motors with a low moment of inertia are used.

In terms of energy saving, this second embodiment of the hydraulic circuit is more advantageous than the first one described above. Indeed, with respect to constant rotation speed motors, variable frequency motors can be activated only when they are actually needed. Moreover, the use of a fixed displacement pump also appears more advantageous because they are less costly, less complex and easier to manage than variable displacement pumps.

In this second embodiment, the main drawback is encountered in the use and management of electric motors with a low moment of inertia. Indeed, besides being very expensive, this type of motors requires various ancillary systems to allow the operation and requisite reliability thereof. These motors, for example, require a liquid cooling system, which is particularly complicated to manage.

Given these considerations, it is the main task of the present invention to provide a press for extruding metals and/or metal alloys which allows overcoming the drawbacks and limits described above. In the scope of this task, it is a first object of the present invention to provide a press in which the hydraulic circuit, responsible for controlling the extrusion cylinders, comprises relatively inexpensive and uncomplicated elements. It is another object to provide a press in which said hydraulic circuit is configured so as to allow a controlled acceleration of the pistons contained in the extrusion cylinders. It is a yet other object of the present invention to provide a press wherein the hydraulic circuit is reliable and easy to be manufactured at competitive costs.

SUMMARY

The present invention therefore relates to a press for extruding metal material wherein said press comprises at least one cylinder in which piston for extruding said metal material is movable. Such a piston is controlled by means of an oil hydraulic circuit which comprises:

at least one constant displacement pump for circulating the oil, said pump being connected to the cylinder by means of a main supply line and being operated by an electric motor with a variable rotation speed;

a branch line hydraulically connected to the main line at a branch point, wherein a shutoff element is arranged along the branch line, which shutoff element is movable between a first opening position and a closing position of said branch line;

a control hydraulic unit, which acts on said shutoff element, to control the movement thereof between said opening position and said closing position, wherein said hydraulic unit comprises a pilot line, independent from said main line and from said branch line, and a pilot valve operatively arranged along said pilot line which identifies a first segment of said pilot line, communicating with said main line upstream of said shutoff element, and a discharging segment of said pilot line; the pilot valve, in an activation configuration, closes said discharging segment of said pilot line and the movement of said shutoff element is determined by the difference existing between the oil pressure in said branch line and the oil pressure in said initial stretch of said pilot line;

a control element, connected to said first segment of said pilot line, which, in an activation condition, and after activating the pilot valve, determines a gradual increase of the pressure in the initial stretch of the pilot line and a corresponding gradual closing movement of the shutoff element.

Advantageously, the control element allows disengaging, at least in the initial step, the acceleration of the piston from the acceleration of the electric motor. Indeed, during such a step, the movement of the piston is determined by the gradual increase of pressure induced by the control element, while the electric motor can accelerate in times of the order of a second, i.e. in times conforming with the inertia of a traditional three-phase electric motor, before the beginning of the piston movement. Therefore, the use of motors with low moment of inertia can be avoided.

According to a first embodiment of the invention, the hydraulic element comprises at least one tank hydraulically connected to the initial stretch of the pilot line. Such a hydraulic element comprises at least one valve switchable between a non-activation state, in which said tank does not communicate with said initial stretch of said pilot line, and an activation state, in which said tank instead hydraulically communicates with said initial stretch of said pilot line.

Preferably, in this first embodiment, the hydraulic element comprises a plurality of tanks, each of which is connected to the initial stretch of the pilot line upstream of a corresponding pilot valve, and wherein, for each tank, said hydraulic element comprises at least one corresponding valve, switchable between a non-activation condition, in which said tank does not communicate with said initial stretch of pilot line, and an activation condition, in which said tank instead hydraulically communicates with said initial stretch of said pilot line.

According to another aspect, said tanks have different volumes.

According to a second embodiment, alternative to the first one indicated above, the control element comprises a proportioning pressure valve, which allows the oil to pass between an inlet and an outlet when the pressure at the inlet exceeds a predetermined set-up value, wherein said inlet is connected to said initial stretch of said pilot line and wherein said pressure set-up value is variable over time from a minimum value to a maximum value.

BRIEF DESCRIPTION OF THE FIGURES

Further features and advantages of the invention will be more apparent from the examination of the following detailed description of some preferred, but not exclusive embodiments, illustrated by way of non-limiting example, with reference to the accompanying drawings, in which.

The same reference numbers and letters in the figures refer to the same elements or components.

DETAILED DESCRIPTION OF THE PRESENT INVENTION

Figure 1:
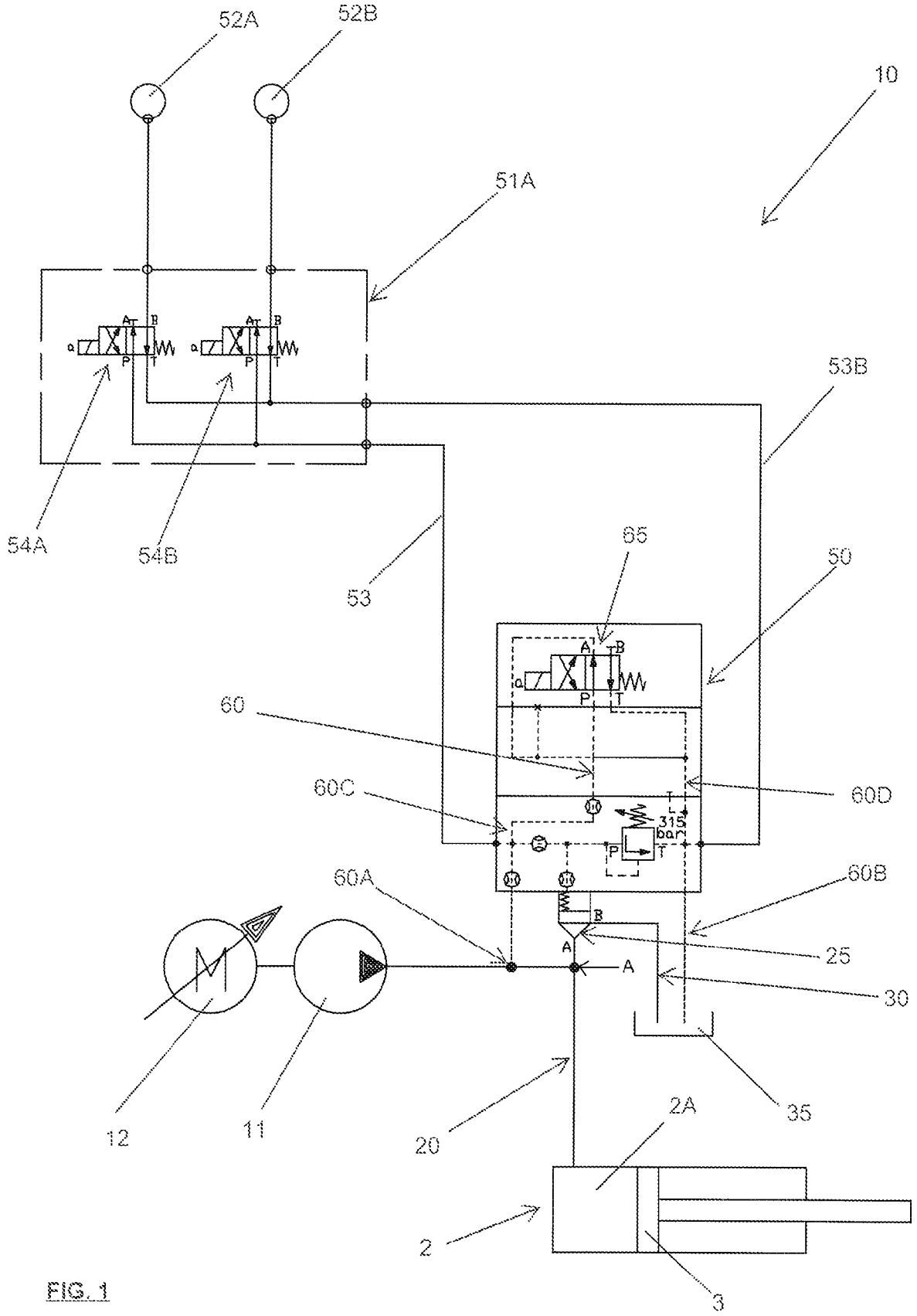
FIGS. 1, 2 and 3 diagrammatically show a first embodiment of a hydraulic circuit of a press according to the invention in different configurations.

The present invention thus relates to a press for extruding metal material, which may be steel, aluminum, copper, lead, metal alloys, ferrous or non-ferrous alloys. The press according to the invention comprises at least one cylinder 2 comprising a chamber 2A in which a piston 3 is movable. According to a principle known per se, the piston 3 has the function of pushing the metal material through a die to obtain an extruded metal profile.

The press comprises a hydraulic circuit 10 for controlling the movement of the piston 3. More precisely, the hydraulic circuit 10 is of the hydrodynamic type providing oil as operating fluid. The hydraulic circuit 10 comprises a pump 11 for circulating the oil which is driven by an electric motor 12. In particular, the pump 11 is a fixed displacement pump and the electric motor is a three-phase asynchronous motor of the conventional type.

The hydraulic circuit 10 comprises a main line 20, which connects the supply side of the pump 11 to the chamber 2A of the cylinder 2. This latter can be single-acting or double-acting according to operating configurations known per se to a person skilled in the art. The main line 20 comprises a branch point A from which a hydraulic branch 30 extends, along which a flow shutoff element 25 is provided. The hydraulic branch 30 puts the main line 20 into communication with a discharge tank 35. In the segment comprised between the branch point A of the main line 20 and the shutoff element 25, the oil pressure is the same and corresponds exactly to that at said branch point A.

The shutoff element 25 is movable between a first reference position and a second reference position. The first reference position is characteristic of a complete opening condition of the hydraulic branch 30, while the second reference position is characteristic of a complete closing condition. More precisely, when the shutoff element 25 occupies the first reference position, the entire fluid flow, supplied by the pump 11, crosses the hydraulic branch 30 and is discharged into tank 35. On the contrary, when the shutoff element 25 occupies the second reference position, the flow through the hydraulic branch 30 is stopped and therefore the oil flows only in the main line 20.

The hydraulic circuit 10 comprises a hydraulic control unit 50 which can assume an activation configuration as a result of which the closing movement of said shutoff element 25 is activated. The expression "closing movement" indicates the movement of said shutoff element 25 from said first reference position to said second reference position.

For the purpose indicated above, the hydraulic control unit 50 comprises a pilot line 60 (dashed) independent from said main line 20, provided with an inlet 60A connected either to the branch line 30 or to said main line 20. This means that at said inlet 60A, said pilot line 60 branches off from said main line 20 or from said bypass line 30, thus extending independently therefrom.

Said pilot line 60 further comprises an outlet 60B which allows draining the oil, preferably into tank 35. The hydraulic unit 50 also comprises a pilot valve 65, operatively arranged along said pilot line 60. The latter identifies an initial stretch 60C (or first segment 60C) of the pilot line 60 comprised between said main line 20 and said pilot valve 65 and a discharge segment 60D (or second segment 60D) comprised between said pilot valve and said outlet 60B. In a deactivation condition, the pilot valve 65 puts the inlet 60A and the outlet 60B into communication thus precisely allowing discharge into the oil. In other words, in the deactivation condition, the valve 65 puts the two segments 60C, 60D of the pilot line 60 into communication. On the contrary, in an activation condition, the pilot valve 65 stops the oil flow towards the outlet 60B, thus causing a pressure increase in the initial stretch 60C of said pilot line 60. Preferably, but not exclusively the pilot valve 65 is a four-way and two-position solenoid valve.

From the above, the oil can be discharged through the branch line 30, when the shutoff element 25 occupies the first reference position (opening), and through the pilot valve 65 when it is disabled. In particular, the branch line 30 is independent from the unloading portion 60D of the pilot line 60. In other words, the branch line 30 does not communicate at any point with said discharge segment 60D.

The shutoff element 25 and the hydraulic control unit 50 interact so that the movement of the shutoff element 25 between the two reference positions indicated above is determined by the pressure difference ΔP existing in the main line 20, upstream of said shutoff element 25 (pressure P1) (pressure at said branch point A) and said initial stretch 60C of the pilot line 60 (pressure P2).

According to the invention, the hydraulic control unit 50 comprises at least one control element 51A, 51B connected to said initial stretch 60C of said pilot line 60. In an activation condition thereof, and as a result of the activation of said pilot valve 65, said control element 51A, 51B determines a gradual increase of the pressure in the said initial stretch 60C of the pilot line 60, thus determining a progressive closing movement of the shutoff element 25. For the purposes of the present invention, the expression "gradual movement" or "progressive movement" of the shutoff element 25 means a movement which is completed in the order of tenths of a second, thus excluding a movement of the ON-OFF type, i.e. a substantially instantaneous closing (in the order of milliseconds) of the shutoff element 25 from this definition.

The gradual closing movement of the shutoff element 25 results in a corresponding gradual reduction of the oil volume which goes to the discharge, and a corresponding gradual increase in the oil volume sent towards the chamber 2A of the cylinder 2 through the main line 20 of the hydraulic circuit 10. Therefore, the increase of pressure P2 in the hydraulic control unit 50 ultimately determines an increase of the pressure on the piston 3 to activate the movement thereof.

Advantageously, by controlling the progressive increase of pressure on the piston 3 it is possible to control the acceleration times of the piston itself releasing it from the acceleration of the electric motor 12. Indeed, the electric motor 12 is at the optimal rotation speed before the actuation of the pilot valve 65 and may be taken to said speed with an acceleration implemented in a time in the order of a second. By increasing the acceleration time, the electric motor 12 can absorb low currents with respect to those normally required in the traditional solutions in which the piston 3 is accelerated only by the electric motor. At the same time, given longer acceleration times granted to the electric motor 12, the latter may assume a conventional configuration, i.e. not necessarily of the type with a low moment of inertia.

In a first embodiment, the control element 51A comprises at least one tank 52A, 52B connected branching from the first segment 60C of the pilot line 60 of the hydraulic control unit 50. The expression "connected branching" is meant to indicate a condition for which the tank is connected to the initial stretch 60C through a further hydraulic branch 53. The control element 51A comprises at least one valve 54A, 54B switchable between a deactivation condition, in which the tank 52A, 52B is not connected to said first segment 60C, and an activation condition in which the tank 52A, 52B is connected to said segment 60C. The tank 52A, 52B is normally filled with oil.

Figure 2:
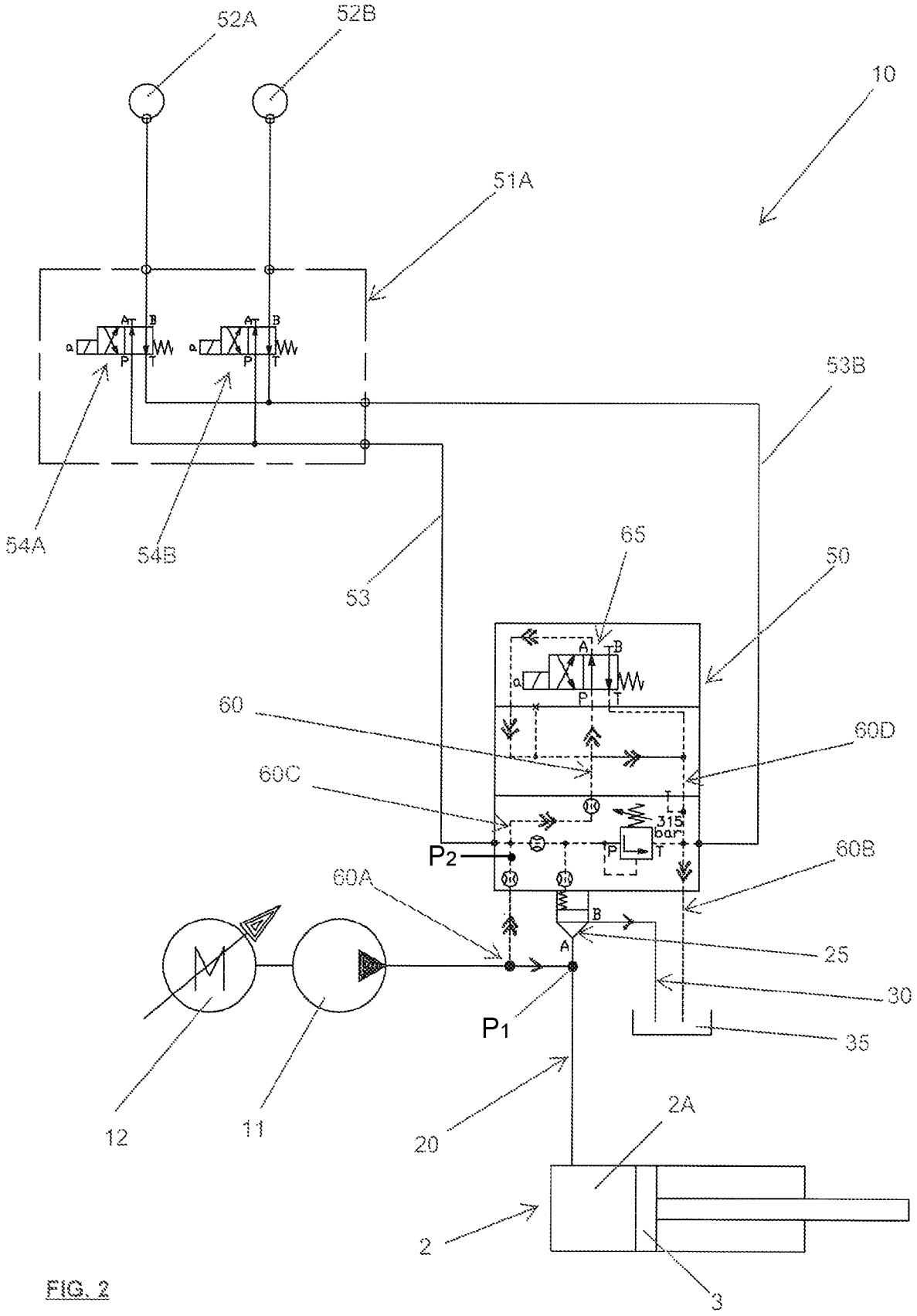
Figure 3:
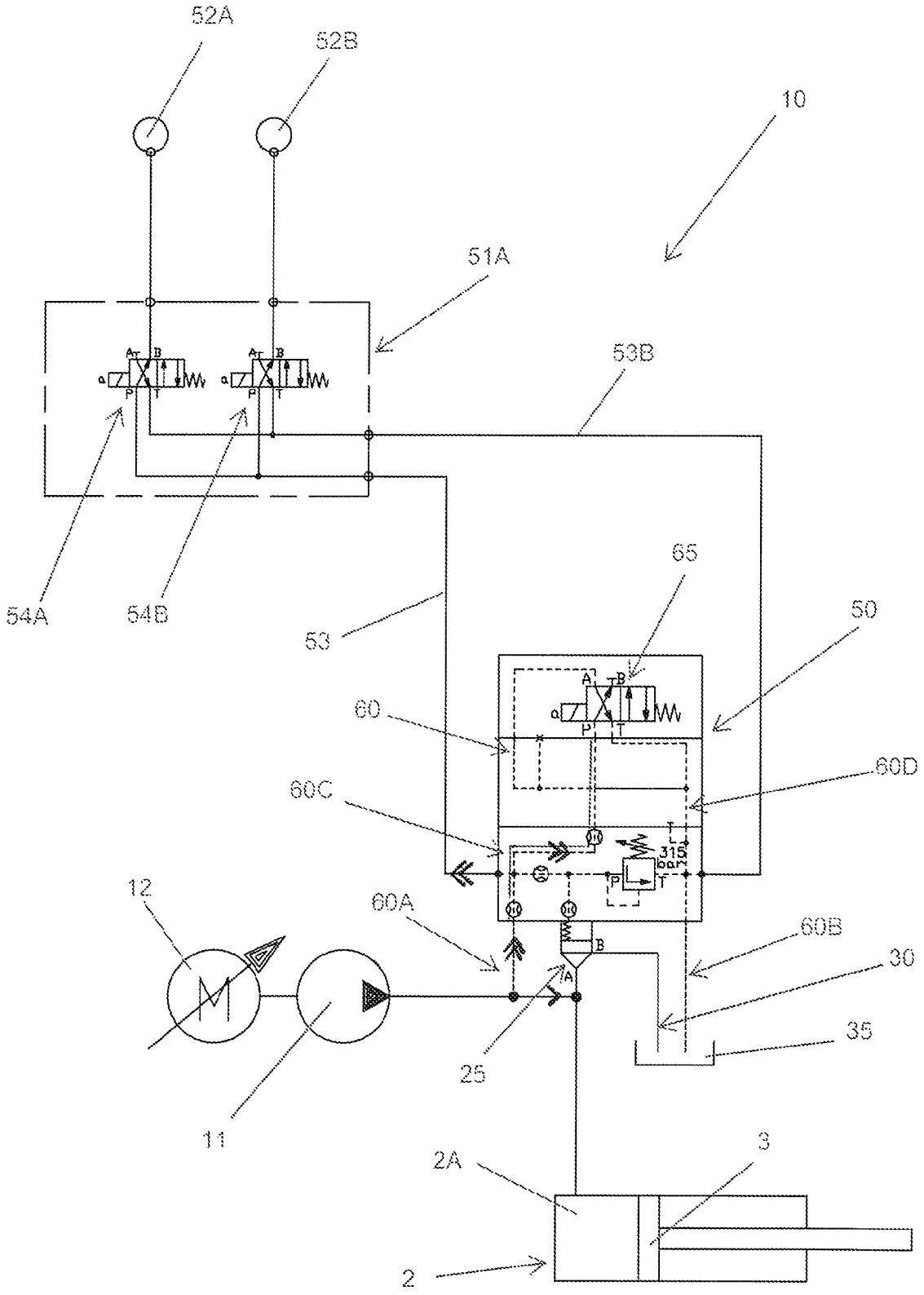

With reference to FIGS. 1 to 3, the control element 51A preferably comprises a plurality of tanks 52A, 52B connected to said first segment 60C of the pilot line 60, preferably through the same hydraulic branch 53. A corresponding valve 54A, 54B is provided for each tank 52A, 52B which is switchable between an activation condition and a deactivation condition in accordance to what has just been described above. Preferably, the two valve 54A, 54B are four-way and two-position solenoid valves. Preferably, the two tanks 52A, 52B have different volumes. The control element 51A also comprises a discharge line 53B which allows the discharge of the pressure of the tanks 52A, 52B when the corresponding valve is deactivated.

FIG. 1 shows the hydraulic circuit in a resting condition, i.e. before the activation of the circulation pump 11 by means of the motor 12. In the condition illustrated in FIG. 1, the pilot valve 65 is deactivated and the shutoff element 25 occupies the first reference position corresponding to the total opening of the branch line 30.

As soon as the electric motor 12 is activated, the pump 11 sends a fixed oil flow which crosses the branch line 30. In this condition, diagrammatically shown in FIG. 2, the oil also passes through the pilot line 60 (shown by dashed lines in FIG. 2) of the hydraulic control unit 50. The value of the pressure P1 in the branch line 30 corresponds to the value of the pressure P2 in the pilot line 60 (P1=P2) and therefore the shutoff element 25 stably maintains the first reference position defined above. In FIG. 2, the double arrow indicates the path of the oil in the hydraulic control unit 50, while the single arrow indicates the oil flow along the branch line 30. It is worth noting that in the discharging condition of FIG. 2, the control element 51A does not intervene because the valves 54A, 54B thereof are deactivated.

With reference to FIG. 3, when the pilot valve 65 is activated, the flow in the pilot line 60 is stopped and the pressure P2 of the oil increases in the first segment 60C. If neither valve 54A, 54B of the control element 51A is activated, the closing of the pilot valve 65 would determine a very fast closing movement (in the order of thousandths of a second) of the shutoff element 25. In this hypothesis, the acceleration of the piston 3 would necessarily be entrusted to the action of the electric motor 12. In order to make the movement gradual (preferably in the order of tenths of a second) and therefore in order to gradually increase the pressure on the piston 3, at least one valve 54A, 54B of the control element 51A is activated before the activation of the control valve 65.

Thereby, as a result of the closing of the control valve 65 and due to the effect of the hydraulic branch 53, the oil reaches the tank 52A by increasing the pressure inside it. This pressure increase is transmitted in the branch line 53 and in the initial stretch 60C of the pilot line 60. In FIG. 3, the first segment 60C is indicated with a double line, one dashed line and one solid. The gradual increase of the pressure P2 determines the progressive closing of the shutoff element 25 and the corresponding increase in the quantity of oil sent to the piston 3.

The control element 51A thus uses the compressibility of the oil to gradually increase the value of the pressure P2 inside of the controlling hydraulic unit 50 and ultimately for increasing the pressure inside the main line 20, i.e. the acceleration of the piston 3. Therefore, according to which or how many valves 54A, 54B of the control element 51 are activated, it will be possible to vary the response of the hydraulic control unit 50 with reference to the closing of the shutoff element 25 or to the acceleration of the piston 3. Indeed, the control element 51A allows setting the acceleration times of the piston 3 without intervening in any manner on the electric motor 12. When the closing of the shutoff element 25 is completed, i.e. when the entire volume of oil processed by the pump 11 is sent to the cylinder 2 (branch line 30 closed), the electric motor 12 is already at speed to maintain the thrust on the piston 3 constant. It follows that, when the maneuver is started, the motor is already at rotation speed.

This condition allows an advantageous containment of the current absorbed by the motor in the starting step because the acceleration of the motor can be achieved in terms of a second and not of a tenth of a second.

Figure 4:
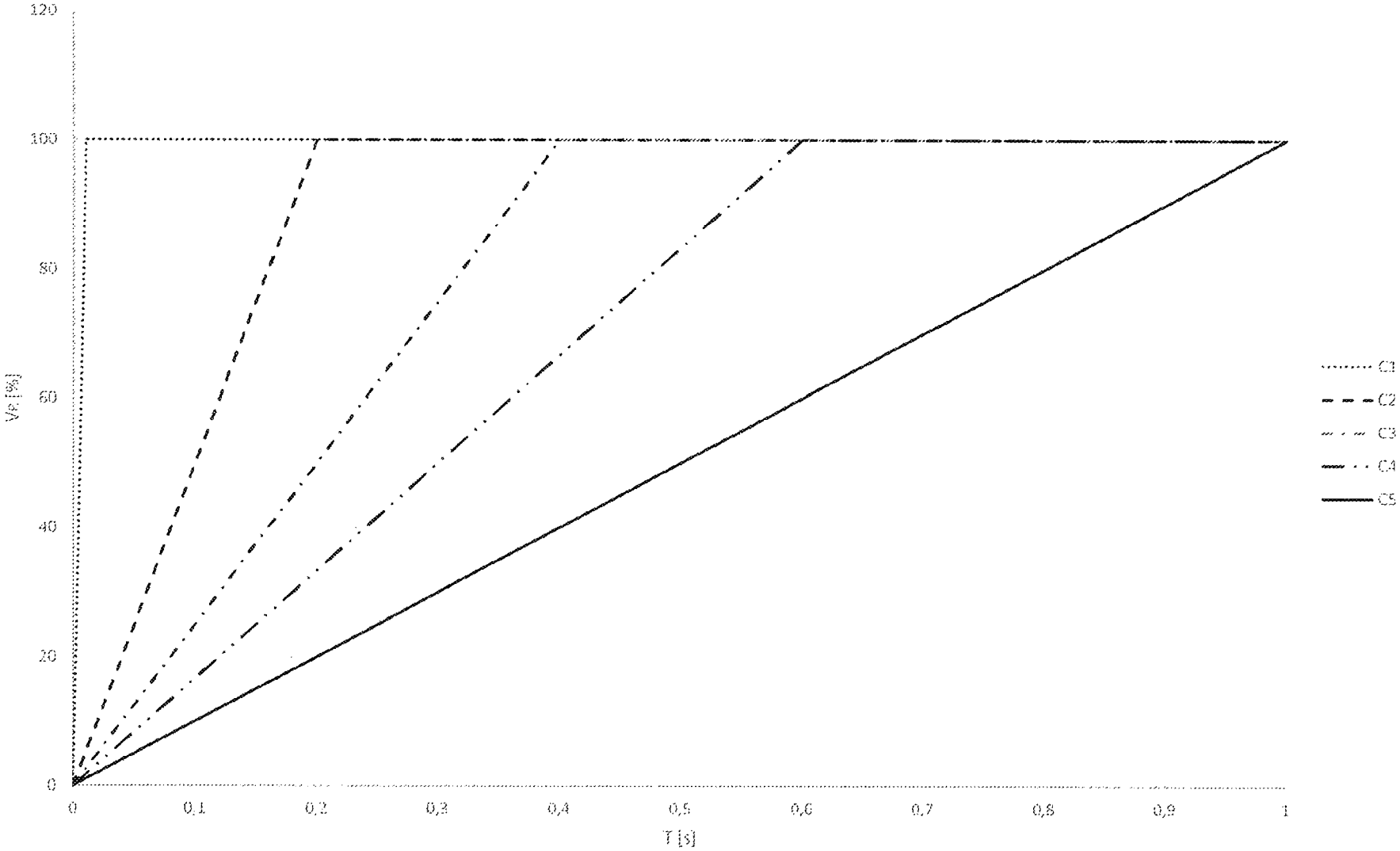
FIG. 4 is a diagram indicating possible acceleration curves of a piston of a press according to the present invention.

The chart in FIG. 4 shows some acceleration curves (C1, C2, C3, C4, C5) (speed value over time) obtainable through the hydraulic circuit 10 of the press according to the invention. In particular, these curves C1, C2, C3, C4, C5 refer to the time needed to take the speed of the piston from a zero value to a reference value VR.

The curve C1 represents an undesired condition of operation which would occur if the control element 51 remains deactivated, i.e. if none of the tanks 52A, 52B is inserted in the hydraulic circuit of the hydraulic control unit 50 following the closing of the control valve 65. In this hypothesis, the acceleration of the piston C1 would be instantaneous, i.e. implemented in the range of the order of thousandths of a second. To support this acceleration curve, the peak current absorbed by the motor 12 would be very high and there would be a risk of mechanical damage to the system.

The curves C2 and C3 respectively indicate the behavior of the hydraulic circuit 10 if a first valve 54A or a second valve 54B is activated respectively, and if the first tank 52A, referred to the first valve 54A, has a lower volume than a second tank 52B, referred to the second valve 54A. The curve C4 instead shows the behavior if both valves 54A, 54B are activated simultaneously, i.e. if both tanks 52A, 52B are made to communicate with the first segment 60C of the pilot line 60 of the hydraulic control unit 50.

By comparing the curves C2, C3 and C4, it can be noted that the increase of the volume of the hydraulic circuit of the hydraulic control unit 50 determines an increase in the acceleration times of the piston 3, i.e. makes this acceleration more gradual. The expression "hydraulic volume of the hydraulic control unit 50" indicates the total volume given by the sum of the volumes of the initial stretch 60C, of the branch line 53 and of the tanks 52A, 52B.

Advantageously, acceleration times in the order of tenths of a second can be achieved for the curves C2, C3 and C4. According to the operating conditions of the press, determined for example by the step of the cycle of the press, one of the curves C1, C2, C3, C4, C5 may be more suitable than the others. It will therefore be possible to act on the control element 51, i.e. on the valves 54A, 54B, so as to obtain a response corresponding to that of the curve considered to be most suitable for the particular application. This possibility advantageously increases the press operational versatility.

Referring again to FIG. 4, the curve C5 provides an acceleration in the order of 1 second. It is worth noting that this acceleration time is compatible with the one achievable by an asynchronous electric motor. Therefore, if the operating conditions allow such a long acceleration time, the control element 51 could remain deactivated and the acceleration of the piston 3 would be entrusted exclusively to the action of the electric motor 12.

On the basis of the above, the control element 51A may therefore comprises only one tank, two tanks (as diagrammatically shown in FIGS. 1 to 3) or a number of tanks greater than two. Substantially, the configuration of the control element 51A may change according to the application and/or according to the control possibilities of the piston one desires to confer to the press.

Figure 5:
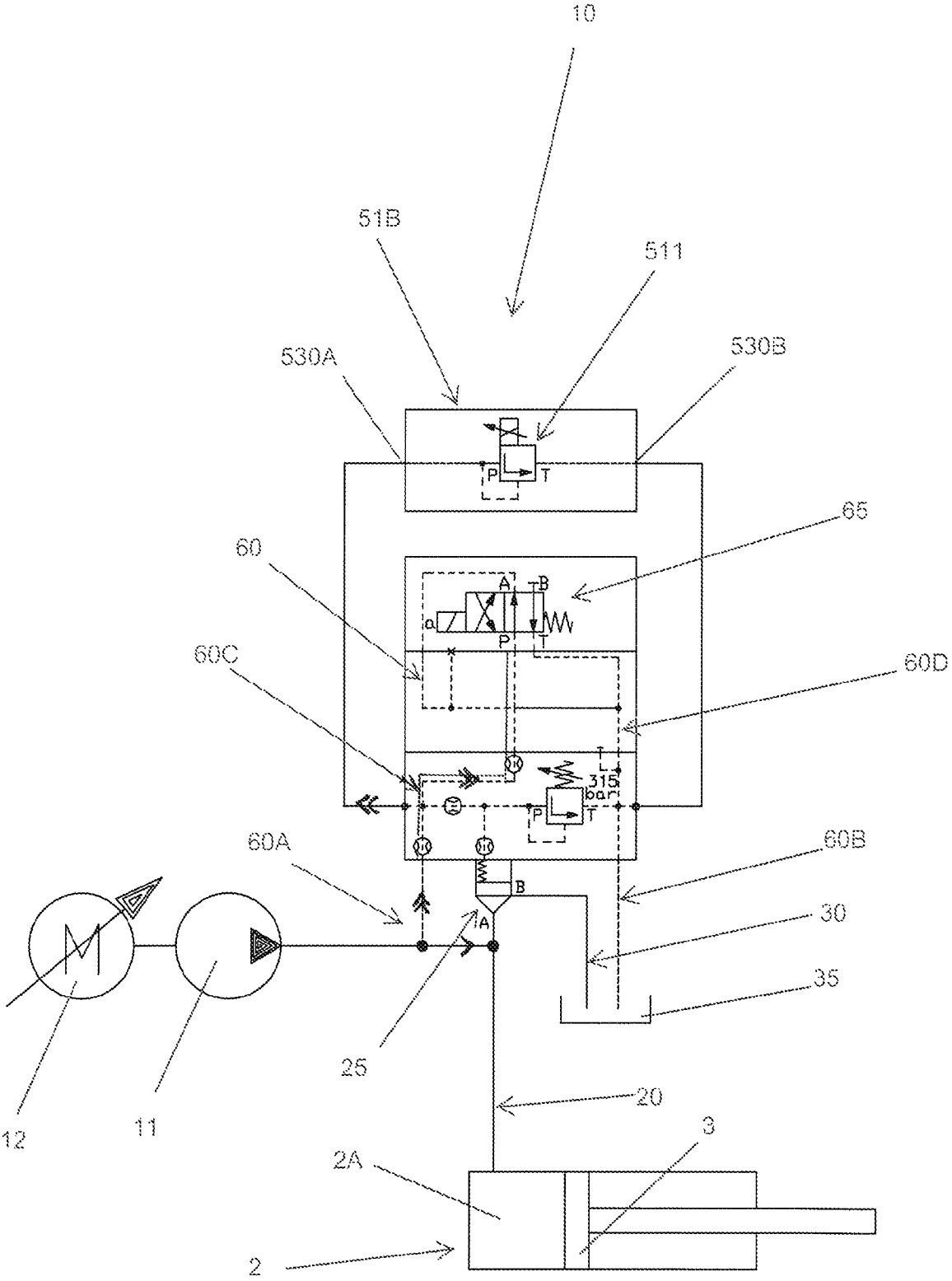
FIG. 5 diagrammatically shows a second embodiment of a hydraulic circuit of a press according to the invention.

In an alternative embodiment of the invention, shown in FIG. 5, the control element (indicated by reference numeral 51B) comprises a proportioning pressure valve 511. This latter comprises an inlet 530A connected branching (branch line 530 or branch 530) with the first segment 60C of the pilot line 60 of the hydraulic unit 50 and an outlet 530B connected to the second discharging segment 60D of the pilot line 60, i.e. downstream of the control valve 65 to be discharged into the collection tank 35.

The proportioning pressure valve 511 allows the oil to pass from the inlet to the outlet when the pressure at the inlet 530A exceeds a predetermined set-up value. In this regard, the pressure at the inlet 530A corresponds to the pressure P2 which intervenes on the shutoff element 25.

In order to achieve a gradual increase in the pressure P2, i.e. in order to control the acceleration time of the piston 3, the proportioning pressure valve 511 is configured so that the set-up value is variable over time, preferably in continuous manner, from a null value $P_0$ to a maximum value $P_{max}$. When the set-up value is null $P_0$, the valve 511 is opened and the branch 530 discharges. With the increase of the set-up value, the volume of oil which crosses the valve 511 decreases and therefore the pressure at the inlet 530*a* of the valve itself or the pressure P2 in the first segment 60C of the pilot line 60 of the hydraulic unit 50 increases.

In a substantially resting configuration (shown in FIG. 5), the pilot valve 65 is deactivated and the shutoff element 25 occupies the first reference position (completely open). Therefore, as a result of the activation of the electric motor 12, the oil flow processed by the circulation pump 11 crosses the branch line 530 toward the tank 35.

Following the activation of the control valve 65, the oil flow through the pilot line 60 of the hydraulic control unit 50 is prevented and therefore the oil is directed naturally into branch 530 towards the pressure proportioning valve 511, the pressure set-up value of which is initially zero. As said set-up value increases, the oil flow which crosses the valve itself decreases and therefore the pressure P2 value increases in the initial stretch 60C of the pilot line 60. This condition results in a progressive movement of the shutoff element 25 and ultimately in a gradual increase in pressure in the piston 3 and the pump 11.

So, in this embodiment, the acceleration times depend on the variation over time of the pressure set-up values of the proportioning valve 511. Thus, the acceleration times can be increased or decreased by decreasing or increasing respectively the speed at which the pressure set-up values vary.

The valve 511 described above therefore allows obtaining the same technical effect which can be achieved by means of the control element 51A described above when commenting figures from 1 to 3. Indeed, through the two embodiments described above, the piston 3 is initially accelerated by the pressure variation within determined by the hydraulic control unit 50 and hence entirely irrespective of the action of the electric motor 12. Thereby, the electric motor 12 can be gradually accelerated with an advantageous saving of energy.

The invention claimed is:

1. A press for extruding metal material, wherein said press comprises at least one cylinder in which a piston is movable for extruding said material, wherein said piston is controlled by means of a hydraulic oil circuit comprising:

at least one fixed displacement pump for circulating said oil, said pump being connected to said cylinder by means of a main supply line and being operated by an electric motor with a variable rotation speed;

a branch line hydraulically connected to said main line at a branch point (A), wherein along said branch line a shutoff element is arranged, which is movable between a first opening position and a closing position of said branch line;

a control hydraulic unit acting on said shutoff element to control the movement thereof between said opening position and said closing position, wherein said hydraulic unit comprises a pilot line, independent from said main line and from said branch line, and a pilot valve operatively arranged along said pilot line, and said pilot valve separating said pilot line into an initial stretch of said pilot line, communicating with said main line, and a second discharging segment of said pilot line, wherein said pilot valve, in an activation configuration, closes said second discharging segment and wherein the movement of said shutoff element is determined by the difference ($\Delta P$) existing between the pressure (P1) in said branch line and the pressure (P2) in said initial stretch of said pilot line;

a control element connected at least to said initial stretch of said pilot line, which, in an activation condition, and after the activation of said pilot valve, determines a gradual increase of the pressure in said initial stretch segment of said pilot line and a corresponding gradual closing movement of said shutoff element, wherein said control element comprises a plurality of tanks, each of which is connected to said initial stretch of said pilot line, and wherein, for each tank, said control element comprises at least one corresponding valve, switchable between a non-activation state, in which said tank does not communicate with said initial stretch of pilot line, and an activation state, in which said tank instead communicates with said initial stretch of said pilot line.

2. The press according to claim 1, wherein said tanks of said control element have different volumes.

3. The press according to claim 1, wherein said control element comprises a pressure valve, which allows the oil to pass between an inlet and an outlet when the pressure at said inlet exceeds a predetermined set-up value, wherein said inlet is connected branching from said initial stretch of said pilot line and wherein said pressure set-up value is variable over time from a minimum value ($P_0$) to a maximum value ($P_{MAX}$).

* * * * *